US010662577B2

(12) United States Patent
Stamper, III et al.

(10) Patent No.: US 10,662,577 B2
(45) Date of Patent: May 26, 2020

(54) STEAM IRON AND METHODS FOR PREPARING A STEAM IRON FOR SHIPMENT

(71) Applicant: Hamilton Beach Brands, Inc., Glen Allen, VA (US)

(72) Inventors: George W Stamper, III, Quinton, VA (US); Rachel Sacks, Richmond, VA (US)

(73) Assignee: Hamilton Beach Brands, Inc., Glen Allen, VA (US)

( * ) Notice: Subject to any disclaimer, the term of this patent is extended or adjusted under 35 U.S.C. 154(b) by 71 days.

(21) Appl. No.: 15/958,597

(22) Filed: Apr. 20, 2018

(65) Prior Publication Data

US 2019/0323166 A1 Oct. 24, 2019

(51) Int. Cl.
*D06F 75/22* (2006.01)
*D06F 75/34* (2006.01)
*D06F 79/00* (2006.01)

(52) U.S. Cl.
CPC ..... *D06F 75/22* (2013.01); *D06F 75/34* (2013.01); *D06F 79/00* (2013.01)

(58) Field of Classification Search
CPC ... D06F 75/00–40; D06F 79/00; B65D 51/00; B65D 51/005; B65D 51/02; B65D 51/16; B65D 75/52; B65D 75/54; B65D 75/58; B65D 77/00; B65D 77/22; B65D 79/00; B65D 81/05
See application file for complete search history.

(56) References Cited

U.S. PATENT DOCUMENTS 1,332,039 A * 2/1920 Hawkes ..... D06F 79/00 38/95
1,566,892 A * 12/1925 McArdle ..... D06F 79/00 38/142
2,578,107 A * 12/1951 Thacker ..... B65D 5/5021 206/703
2,620,576 A * 12/1952 Stevenson ..... D06F 75/14 38/77.3
2,662,316 A * 12/1953 Johnson ..... D06F 75/14 38/77.81
2,680,312 A * 6/1954 Parr ..... D06F 75/14 38/77.83
3,111,780 A * 11/1963 Smith ..... D06F 75/18 38/77.7
3,949,499 A * 4/1976 Schaeffer ..... D06F 75/14 38/77.3
4,688,339 A * 8/1987 Tsai ..... D06F 75/14 219/247
4,688,340 A * 8/1987 Ostrelich ..... D06F 75/14 16/445
6,068,222 A * 5/2000 Stangeland ..... D06F 79/02 248/117.7
D655,878 S * 3/2012 Hajduk ..... D06F 59/04 D32/59
8,420,195 B2 * 4/2013 Ameriguian ..... B32B 33/00 428/192

* cited by examiner

*Primary Examiner* — Ismael Izaguirre
(74) *Attorney, Agent, or Firm* — Alexander D. Raring

(57) ABSTRACT

The present disclosure describes a steam iron having a housing, a handle, a soleplate, a water reservoir comprising a water inlet port, a fill door comprising a plug sized to seal the water inlet port, and a blocking member configured to prevent the plug from sealing the water inlet port during shipment of the steam iron. Methods for preparing a steam iron for shipment are also provided.

16 Claims, 6 Drawing Sheets

STEAM IRON AND METHODS FOR PREPARING A STEAM IRON FOR SHIPMENT

FIELD OF THE INVENTION

The present invention is directed to a steam iron and methods for preparing a steam iron for shipment.

BACKGROUND OF THE INVENTION

Clothes irons (also termed clothing irons, flatirons, or simply irons) are well-known appliances used for applying heat and pressure to smooth wrinkles in clothing and other fabrics. Clothes irons comprise a heating element that heats a metallic soleplate, such that the hot soleplate may be pressed against fabric to smooth wrinkles.

Steam irons are a subset of clothes irons. Steam irons enable steam to be produced and applied to clothing in order to increase an iron's ability to smooth wrinkles and/or to enable wrinkles to be smoothed in fabric that may otherwise be more difficult to smooth with heat alone. Steam irons further comprise a water reservoir and a valve to selectively release water from the water reservoir onto an interior surface of the hot soleplate. The hot soleplate vaporizes the water and the resulting steam is released through holes in the soleplate.

Steam irons comprise one or more openings for introducing water into the water reservoir. To eliminate fluid unintentionally escaping the reservoir, some steam irons include a door and/or plug that covers and/or seals the opening(s) when the steam iron is in use.

Prior to being packaged and shipped, steam irons may be tested for quality control. One quality control test performed on these steam irons is to test water tightness of the seal created between the door/plugs and the opening(s) in the water reservoir. Such tests typically involve filling the water reservoir with water. However, after testing is completed and the water reservoir emptied, some residual water may remain in the water reservoir when the steam iron is packaged and shipped. The seal created between the door/plug and the opening(s) may not allow the residual water to evaporate during shipment. If a consumer purchases a new steam iron and notices the residual water in the water reservoir, he/she may believe the steam iron is defective or used. This may lead to product returns, consumer complaints, lost sales, and/or loss of goodwill.

SUMMARY OF THE DISCLOSURE

Embodiments of the present disclosure are directed to a steam iron comprising a housing, a handle supported by or integral with the housing, a soleplate on a base end of the housing, a water reservoir supported by the housing for holding water to be converted to steam when the steam iron is in use, the water reservoir comprising a water inlet port, a fill door attached to the housing, the fill door comprising a plug sized to seal the water inlet port of the water reservoir, and a blocking member. The blocking member may comprise an arm, the arm extending within the water inlet port and a portion of the blocking member positioned outside of the water inlet port. The blocking member may be configured to prevent the plug from sealing the water inlet port during shipment of the steam iron, thereby enabling any residual water to evaporate during shipping and/or prior to purchase.

Some embodiments of the present disclosure are directed to a method of preparing a steam iron for shipment comprising (1) providing a steam iron having a housing, a handle supported by or integral with the housing, a soleplate on a base end of the housing, a water reservoir supported by the housing for holding water to be converted to steam when the steam iron is in use, the water reservoir comprising a water inlet port, and a fill door attached to the housing, the fill door comprising a plug sized to seal the water inlet port of the water reservoir; (2) filling the water reservoir with water, conducting a quality control test on the steam iron with water in the water reservoir, and emptying the water from the water reservoir; (3) applying a blocking member to the steam iron to prevent the plug from sealing the water inlet port; and (4) packaging the steam iron for shipment.

The present disclosure is explained in greater detail in the drawings herein and the specification set forth below.

DETAILED DESCRIPTION OF THE DISCLOSURE

Figure 1A:
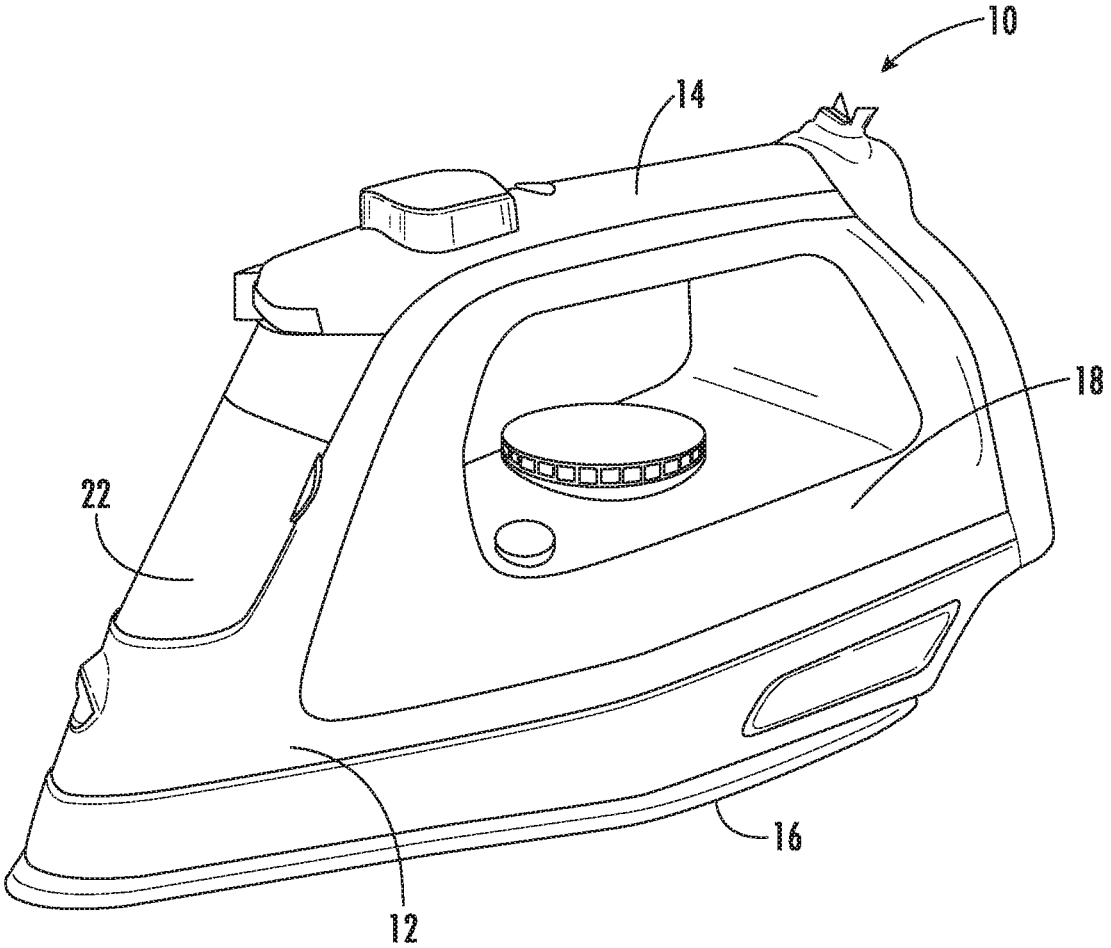
FIG. 1A is a perspective view of a steam iron having a fill door according to embodiments of the present disclosure, the fill door being in a closed position.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 10, 10', 10").

In the figures, certain layers, components or features may be exaggerated for clarity, and broken lines illustrate optional features or operations unless specified otherwise. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention. The sequence of operations (or steps) is not limited to the order presented in the claims or figures unless specifically indicated otherwise.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Figure 1B:
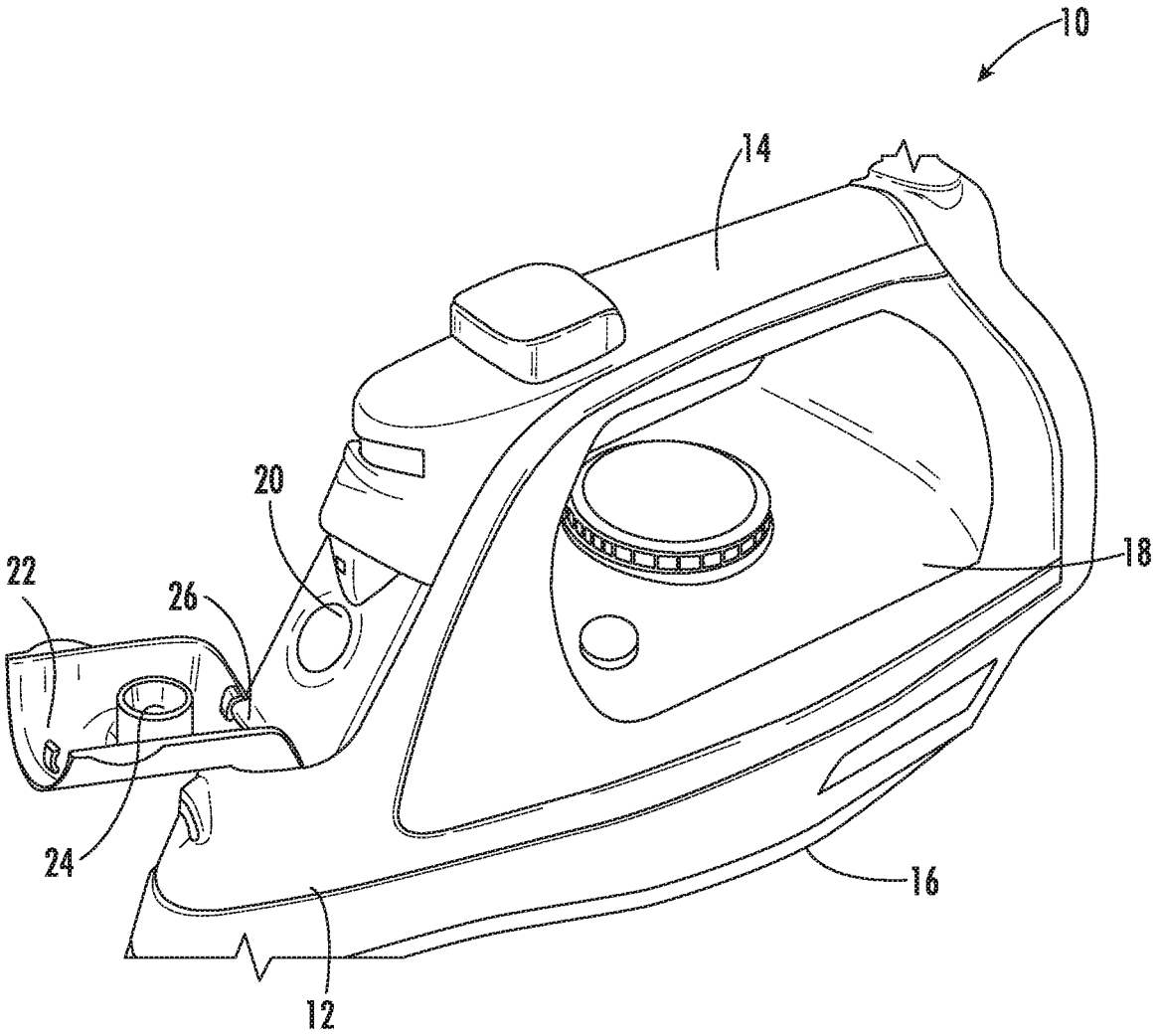
FIG. 1B is a perspective view of the steam iron of FIG. 1A with the fill door open.

Referring now to the figures, FIG. 1A and FIG. 1B illustrate a steam iron 10 according to embodiments of the present invention. The steam iron 10 may comprise numerous components and/or parts, all of which may not be discussed herein. In general, the steam iron 10 may include a housing 12, a handle 14, a soleplate 16, and a water reservoir 18 having a water inlet port 20. The handle 14 may be supported by or integral with the housing 12. Typically, the handle 14 is located on a top end of the housing 12. The soleplate 16 is attached to the housing 12, typically on a base end of the housing 12.

The water reservoir 18 may be supported by the housing 12. In some embodiments, the water reservoir 18 may be used for holding water. The water reservoir 18 can be filled with water through the water inlet port 20. Water contained within the water reservoir 18 can be converted into steam when the steam iron 10 is in use. Notably, the contents of the water reservoir 18 can also be emptied through the water inlet port 20.

In some embodiments, the steam iron 10 may include a fill door 22. The fill door 22 may be attached to the housing 12 in a variety of different ways. For example, in some embodiments, the fill door 22 may be attached to the housing 12 by a hinge 26. In some embodiments, the fill door 22 may be a sliding door or even may be detached. The fill door 22 may be located adjacent to the water inlet port 20 such that when the fill door 22 is in the closed position, the fill door 22 covers and seals the water inlet port 20 (FIG. 1A). Conversely, when the fill door 22 is in an open position, the water inlet port 20 is not covered or sealed (FIG. 1B).

In some embodiments, the steam iron 10 may have a plug 24 attached to the housing 12. For example, the plug 24 may be tethered to the housing 12. In some embodiments, the plug 24 may be attached to or integral with the fill door 22. The plug 24 is typically sized to seal the water inlet port 20 of the water reservoir 18. Thus, when the fill door 22 is in the closed position of FIG. 1A, the plug 24 fits within the water inlet port 20, thereby creating a water-tight seal with the water inlet port 20.

Figure 2:
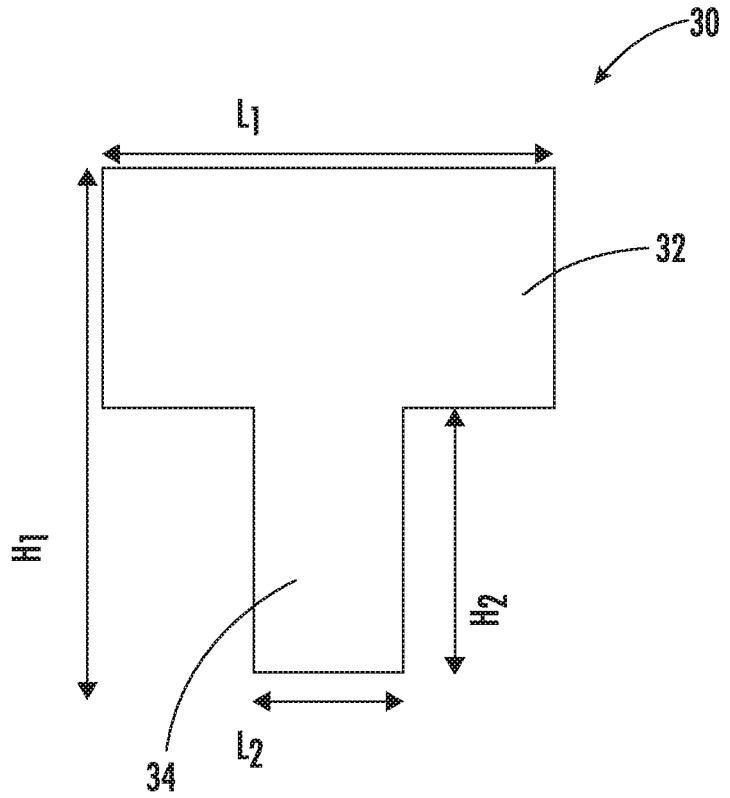
FIG. 2 is a top view of a blocking member according to embodiments of the present disclosure.

Referring now to FIG. 2, the steam iron 10 is shown with a blocking member 30. The blocking member 30 may be used to prevent or "block" the plug 24 from sealing the water inlet port 20. In some embodiments, the blocking member 30 may have an arm 34. The arm 34 of the blocking member 30 may be sized such that when inserted into the water reservoir 18, the arm 34 of the blocking member 30 prevents the entire blocking member 30 from entering into the water reservoir 18 and at least a portion of the arm 34 extends out of the water inlet port 20. In some embodiments, the blocking member 30 may have a base 32 and an arm 34. In some embodiments, the arm 34 may extend orthogonally from the base 32 and may be generally T-shaped.

The blocking member 30 can vary in size depending on the type and/or model of steam iron 10. The base 32 of the blocking member 30 may have a length ($L_1$) and a height ($H_1$) and the arm 34 of the blocking member 30 may have a length ($L_2$) and a height ($H_2$). In some embodiments, the base 32 of the blocking member 30 may have a length ($L_1$) of about 15 mm to about 30 mm and a height ($H_1$) of about 12 mm to about 35 mm. The arm 34 of the blocking member 30 may have a length ($L_2$) of about 8 mm to about 20 mm and a height ($H_2$) of about 12 mm to about 35 mm. For example, in some embodiments, the base 32 of the blocking member 30 may have a length ($L_1$) of about 30 mm and a height ($H_1$) of about 30 mm. The arm 34 of the blocking member 30 may have a length ($L_2$) of about 10 mm and a height ($H_2$) of about 15 mm.

The blocking member 30 can be made from a variety of different materials, including, but not limited to, plastic, silicone rubber, or the like. In some embodiments, the blocking member 30 may comprise adhesive tape or a similar material (see, e.g., FIG. 5). In some embodiments, the blocking member 30 may be made from a material that is sufficiently flexible such that the base 32 of the blocking member 30 can be bent generally parallel with a surface of the steam iron 10 in which the water inlet port 20 is located. In some embodiments, the blocking member 30 may comprise cardboard.

Figure 3:
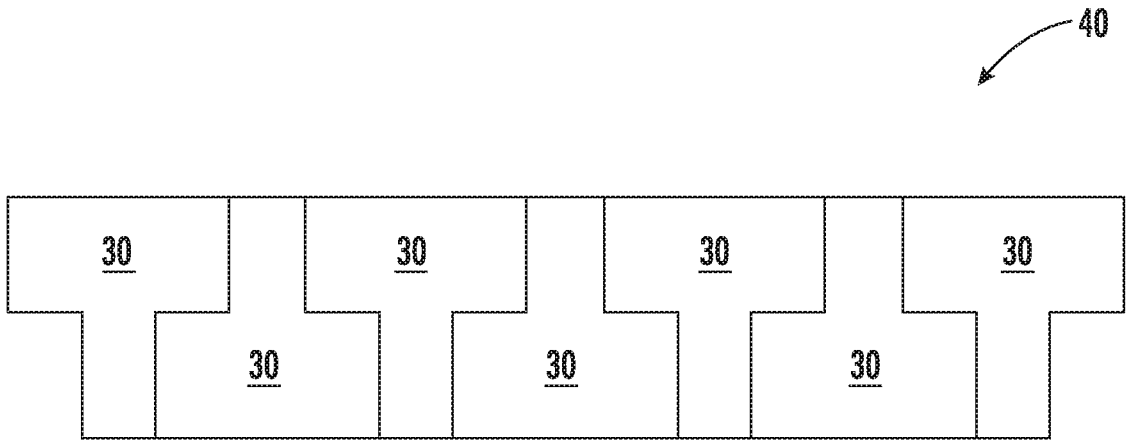
FIG. 3 is a schematic illustration of an exemplary manufacturing layout for the blocking member of FIG. 2.

The blocking member 30 can be manufactured in a variety of ways. FIG. 3 illustrates an exemplary layout of multiple blocking members 30 to be manufactured using a single piece of material. Utilizing this manufacturing layout can reduce the amount of material needed for manufacture, thus reducing production and overhead costs.

Referring now to FIGS. 4A-4D, an exemplary method of preparing the steam iron 10 for shipment using a blocking member is illustrated.

As discussed above, prior to packaging the steam iron 10 for shipment, the steam iron 10 may be subjected to quality control testing. Exemplary quality control testing that may be performed on the steam iron 10 include, but are not limited to, testing the steam function and testing the water reservoir 18. Testing the water reservoir 18 may include testing the seal between the plug 24 of the fill door 22 and the water inlet port 20. This quality control test of the plug 24 may include, but is not limited to, filling the water reservoir 18 with water, closing the fill door 22 to seal the water inlet port 20 with the plug 24, testing the plug 24 and water inlet port 20 for leakage, opening the fill door 22, and emptying the water from the water reservoir 18. As noted above, during the quality control test of the plug 24, all of the water used in the test may not be emptied from the water reservoir 18. Thus, some residual water may remain in the water reservoir 18 when the steam iron 10 is packaged for shipment.

After the quality control test is performed on the steam iron 10, the blocking member 30 (or other blocking member, e.g., blocking member 30') is applied to the steam iron 10. The blocking member 30 prevents the plug 24 of the fill door 22 from sealing the water inlet port 20 once the steam iron is packaged.

Figure 4A:
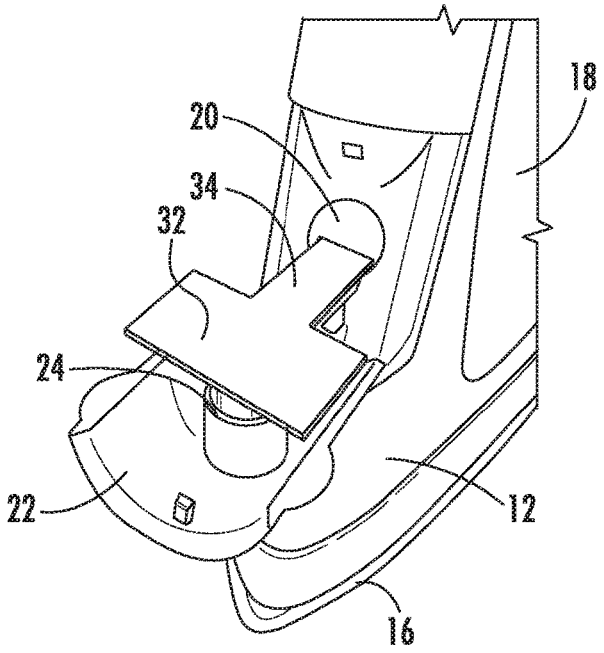
FIG. 4A is an enlarged perspective view of the steam iron of FIG. 1A with the blocking member of FIG. 2, just prior to insertion of the blocking member into the water inlet port of the water reservoir.
Figure 4B:
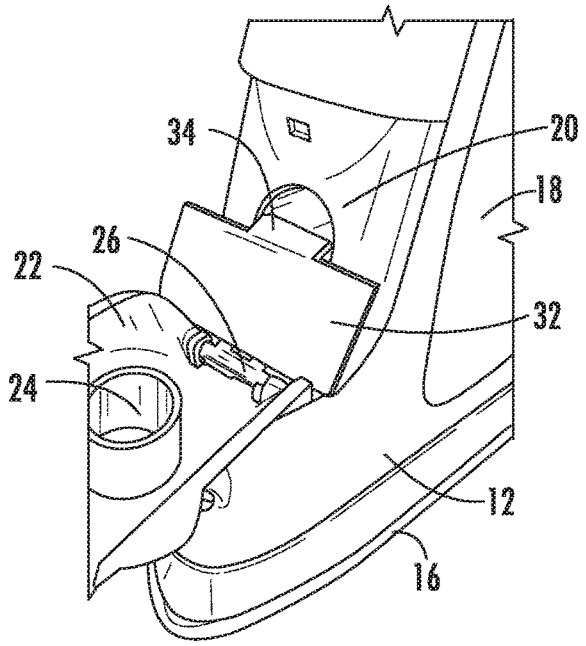
FIG. 4B is an enlarged perspective view of the steam iron with the blocking member of FIG. 4A inserted into the water inlet port of the water reservoir.
Figure 4C:
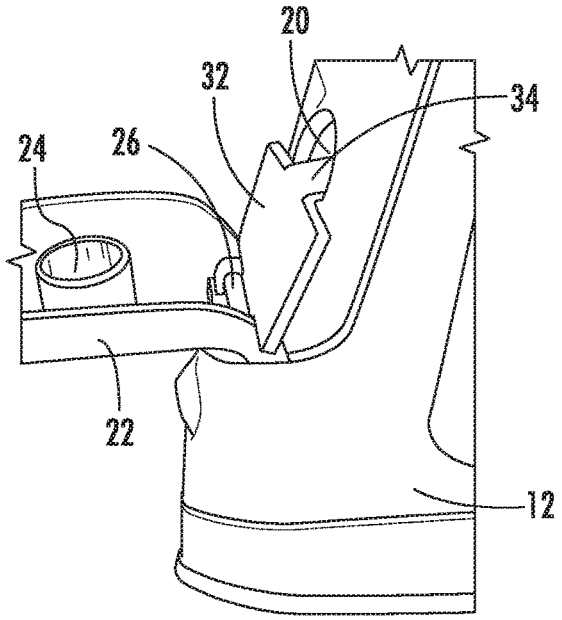
FIG. 4C is an enlarged side view of the steam iron and blocking member of FIG. 4B.
Figure 4D:
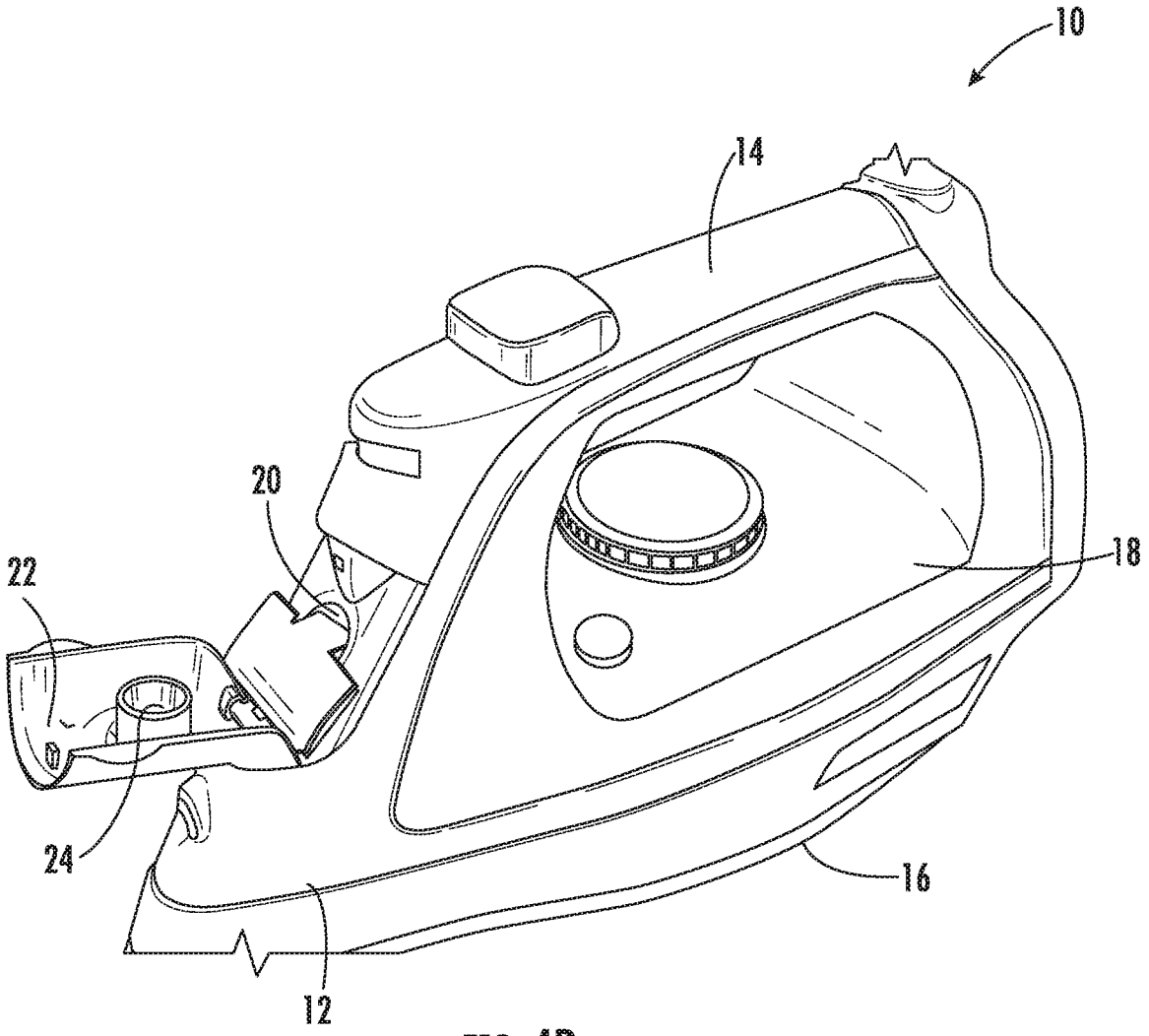
FIG. 4D is a perspective view of the steam iron and blocking member as in FIG. 4B and FIG. 4C.

As shown in FIG. 4A, in some embodiments, a blocking member 30 may be positioned adjacent to the water inlet port 20. The blocking member 30 may be positioned such that the arm 34 of the blocking member 30 extends within the water inlet port 20 and the base 32 of the blocking member 30 is positioned outside and extends on opposite sides of the water inlet port 20 (FIG. 4B). In some embodiments, the blocking member 30 may be anchored in the water inlet port 20. When positioned in this manner, the base 32 can help prevent the entire blocking member 30 from entering into the water reservoir 18. As shown in FIG. 4B and FIG. 4C, in some embodiments, the base 32 of the blocking member 30 can be bent generally parallel with a surface of the steam iron 10 in which the water inlet port 20 is located. In some embodiments, to further secure the blocking member 30, the base 32 may engage with the hinge 26 of the fill door 22 (FIG. 4C). In doing so, the blocking member 30 can prevent the fill door 22 from closing over the water inlet port 20, thus preventing the plug 24 from creating a seal with the water inlet port 20 (FIG. 4D).

The steam iron 10 with the blocking member 30 may then be packaged for shipment. As such, during shipping of a packaged steam iron 10 to a remote location, the blocking member 30 can prevent the plug 24 from sealing the water inlet port 20, thereby allowing any residual water contained in the water reservoir 18 from the quality control test to evaporate. Thus, by the time the steam iron 10 reaches an end user, no water should remain in the water reservoir 18, and there should be no misperception by the end user that the steam iron 10 has been previously owned or used. The end user removes the blocking member 30, at which time the steam iron 10 is ready for use.

Figure 5:
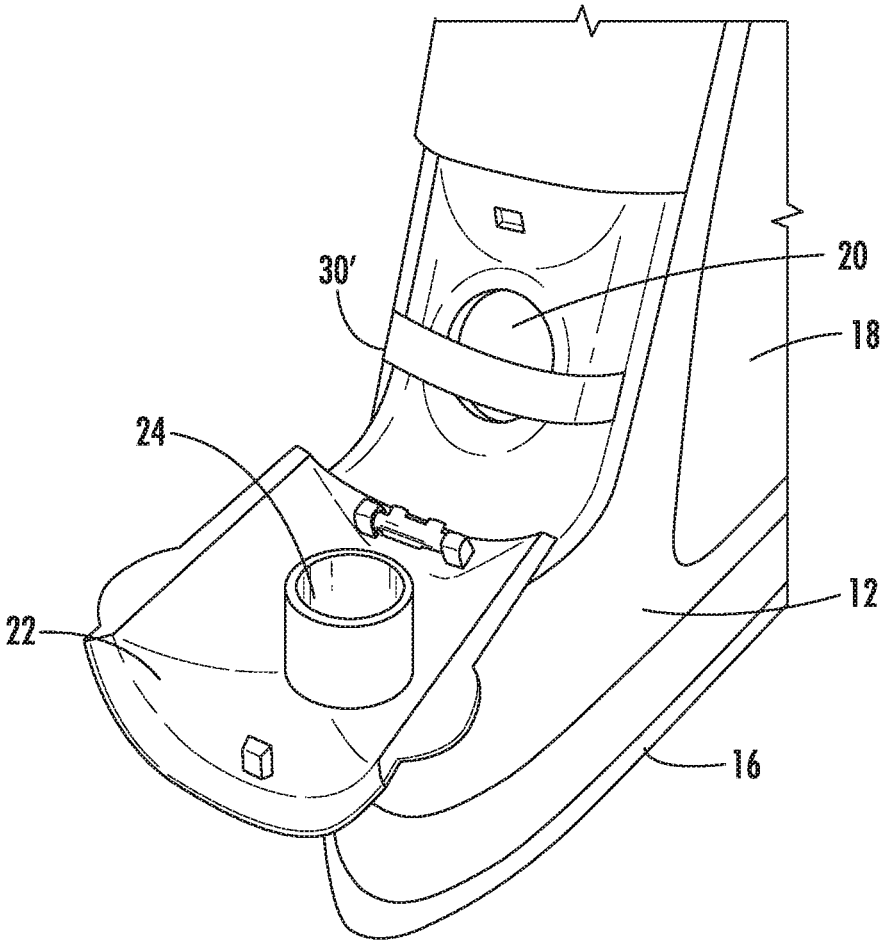
FIG. 5 is an enlarged perspective view of a steam iron with a blocking member according to embodiments of the present disclosure.

FIG. 5 illustrates another example of a blocking member 30' according to embodiments of the present invention. Blocking member 30', which can be a strip of adhesive or the like, prevents the plug 24 from sealing the water inlet port 20 in a similar manner as disclosed above.

As another example, in some instances the steam iron 10 may be packaged with protective material (tissue paper, kraft paper, cardboard shims and stays, or the like) that is designed to prevent the iron from being scratched or otherwise marred during shipping. In some embodiments, the protective material may be employed as a blocking member that prevents the fill door 22 from closing. As an example, tissue or kraft paper may be arranged to remain between the fill door 22 and the water inlet port 20 to prevent the fill door 22 from closing. As another example, a cardboard shim may include a finger or other projection that extends between the fill door 22 and the water inlet port 20. Other variations of blocking members employing packing material may also be employed.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A steam iron comprising:

a housing;

a handle supported by or integral with the housing;

a soleplate on a base end of the housing;

a water reservoir supported by the housing for holding water to be converted to steam when the steam iron is in use, said water reservoir comprising a water inlet port;

a fill door attached to the housing, said fill door comprising a plug sized to seal the water inlet port of the water reservoir;

a blocking member, said blocking member comprising an arm, said arm extending within the water inlet port and a portion of the blocking member positioned outside of the water inlet port, wherein said blocking member is configured to prevent the plug from sealing the water inlet port during shipment of the steam iron.

2. The steam iron of claim 1, wherein the blocking member is generally T-shaped and further comprises a base.

3. The steam iron of claim 2, wherein the base of the blocking member has a length of about 15 mm to about 30 mm and a height of about 12 mm to about 35 mm, and the arm of the blocking member has a length of about 8 mm to about 20 mm and a height of about 12 mm to about 35 mm.

4. The steam iron of claim 1, wherein the blocking member comprises cardboard.

5. The steam iron of claim 1, wherein the blocking member further comprises a base and the blocking member is bent such that the base engages a portion of the housing or the fill door external to the water inlet port.

6. The steam iron of claim 1, wherein the fill door is attached to the housing via a hinge.

7. A method of preparing a steam iron for shipment, the method comprising:

providing a steam iron, said steam iron comprising a housing, a handle supported by or integral with the housing, a soleplate on a base end of the housing, a water reservoir supported by the housing for holding water to be converted to steam when the steam iron is in use, said water reservoir comprising a water inlet port, a fill door attached to the housing, and a plug sized to seal the water inlet port of the water reservoir;

filling the water reservoir with water, conducting a quality control test on the steam iron with water in the water reservoir, and emptying the water from the water reservoir;

applying a blocking member to the steam iron to prevent the plug from sealing the water inlet port; and packaging the steam iron for shipment.

8. The method of claim 7, further comprising opening the fill door, filling the water reservoir with water, closing the fill door to seal the water inlet port, and conducting a quality control test on the plug and water inlet port for leakage.

9. The method of claim 7, wherein said blocking member comprises a base and an arm extending orthogonally from the base, said arm extending within the water inlet port and said base positioned outside and extending on opposite sides of the water inlet port.

10. The method of claim 7, the method further comprising anchoring the blocking member in the water inlet port, thereby preventing the fill door from closing over the water inlet port.

11. The method of claim 7, the method further comprising shipping the packaged steam iron to a remote location, wherein the blocking member prevents the plug from sealing the water inlet port during shipping, thereby allowing any residual water contained in the water reservoir from the quality control test to evaporate.

12. The method of claim 7, the method further comprising removing the blocking member prior to use by an end user.

13. The method of claim 9, wherein the blocking member is generally T-shaped.

14. The method of claim 13, wherein the base of the blocking member has a length of about 15 mm to about 30 mm and a height of about 12 mm to about 35 mm, and the arm of the blocking member has a length of about 8 mm to about 20 mm and a height of about 12 mm to about 35 mm.

15. The method of claim 7, wherein the blocking member comprises cardboard.

16. The method of claim 13, wherein the blocking member is bent such that the base engages a portion of the housing or the fill door external to the water inlet port.

* * * * *